United States Patent [19]

Deschner

[11] 4,233,885

[45] Nov. 18, 1980

[54] APPARATUS FOR IMPROVED MOTION CONTROL

[76] Inventor: Richard E. Deschner, 5550 Harcross Dr., Los Angeles, Calif. 90043

[21] Appl. No.: 954,101

[22] Filed: Oct. 24, 1978

Related U.S. Application Data

[62] Division of Ser. No. 783,006, Mar. 30, 1977, abandoned.

[51] Int. Cl.[3] ..... F01B 11/02; F15B 13/04

[52] U.S. Cl. ..... 91/410; 91/404; 92/85 A

[58] Field of Search ..... 91/404, 410, 275; 251/73, 74; 92/85 A

[56] References Cited

U.S. PATENT DOCUMENTS

| | | | |
|---|---|---|---|
| 1,017,389 | 2/1912 | Dickson | 92/85 A |
| 1,877,701 | 9/1932 | Speck et al. | 91/410 |
| 1,960,973 | 5/1934 | Knight | 251/74 X |
| 2,447,968 | 8/1948 | Trotter | 91/410 X |
| 2,587,182 | 2/1952 | Livers | 91/404 |
| 3,027,152 | 3/1962 | Deschner | 267/64 |
| 3,169,546 | 2/1965 | Wenzl | 251/73 X |
| 3,176,972 | 4/1965 | Deschner | 267/127 |
| 3,382,770 | 5/1968 | Berninger et al. | 91/275 |
| 3,668,975 | 6/1972 | Nelson | 92/85 A |

*Primary Examiner*—Irwin C. Cohen

*Attorney, Agent, or Firm*—Stevens, Davis, Miller & Mosher

[57] ABSTRACT

An improved type of hydraulic control cartridge with mounting structure and accessorial safety device for installation within both ends of reciprocative pneumatic actuators to permit a safe increase in their speed of operation. The safety device automatically stops the actuator if the hydraulic cartridge malfunctions.

8 Claims, 44 Drawing Figures

APPARATUS FOR IMPROVED MOTION CONTROL

This is a division of application Ser. No. 783,006 filed Mar. 30, 1977, now abandoned.

CROSS REFERENCE TO RELATED PATENTS

The improved hydraulic cartridge described herein is similar in some respects to those described in U.S. Pat. Nos. 3,027,152 and 3,176,972 copies of which are included with this disclosure. Also included are copies of U.S. Pat. No. 3,680,970 and industrial bulletins entitled "Cushioneer" and "Kinecheks".

BACKGROUND OF THE INVENTION

1. Field of the Invention

Many types of industrial machinery have reciprocative or oscillatory mechanisms actuated pneumatically or by gravity or springs. A majority of such devices are operated by reciprocative pneumatic actuators, and in the main, the present disclosure describes problems involved in the use of such actuators and the solution of those problems. It is intended however that the use of the new improved hydraulic cartridges described herein not be limited to pneumatic actuators.

2. Description of the Prior Art Regarding Actuators

The usual reciprocative pneumatic actuator consists of a single cylinder with reciprocative piston and rod, the cylinder being closed at its ends by heads through which compressed air is supplied and exhausted. When compressed air enters the cylinder it tends to move the air piston so quickly and with such force that the piston and any moving load attached to it strike with heavy impact at the ends of the stroke. The impact resulting from an air piston striking the heads can be severe enough to damage the actuator and the mechanism driven by it. The impact can easily be great enough to shear off the mounting bolts of the actuator completely, thereby releasing the same from its base. The consequent danger to personnel and equipment is readily understandable, yet many pneumatic actuators are operated just as they are received from the seller, with no safeguarding against impact, so that direct impact of the piston against one or both of the heads often provides the only means of stopping the piston and its attached load. Such actuators must be operated at low speed at much less than their potential power output to save them from destruction. Operation at a safe low speed is usually accomplished by restricting the flow of air to or from the actuator, most pneumatic actuators being operated at speeds much lower than would be most economical for the moving load attached to them, because the operator adjusts the airflow low enough to be on the safe side. An expensive loss in efficiency occurs then because the full stroke of the air piston must be traveled at low speed, with consequent low productive capacity of the device.

Prior Art Regarding Pneumatic Cushions

Pneumatic actuators may be purchased equipped with one or two pneumatic cushions, each of which consists of a valving device for closing the exhaust passage at one of the cylinder to trap air to decelerate the piston as it reaches the end of its stroke. This type of cushion is effective only for slow moving or lightly loaded pistons. The trapped air acts like a spring and has relatively little decelerative action because it is not compressed to an effective braking pressure until a small fraction of an inch before the piston reaches the end of its stroke.

Prior Art Regarding External Hydraulic Decelerators

Moving mechanisms actuated by pneumatic actuators are sometimes equipped with external hydraulic decelerators to decelerate the mechanism at the ends of its stroke to permit a high operating speed. One type of such decelerator unit is described in the enclosed bulletin entitled "Cushioneer". It consists of a hydraulic cylinder with a reciprocative fluid damped plunger and is usually mounted at a distance from the actuator so that some portion of the moving mechanism strikes the plunger.

A notable point is that with such an arrangement, each time the moving load is brought to a stop, the hydraulic decelerator converts to heat a large percentage of the air power expended during the stroke, the heat being generated by friction within the hydraulic fluid as it is forced through restrictive flow passageways. If operation of the pneumatic actuator is fast and continual, the decelerator becomes so hot that the elastomeric seals it contains may be damaged unless the decelerator is cooled by some external means that dissipates the heat. A measure of cooling can be effected by leading the exhaust air from the actuator to impinge against the outside surface of the body of a decelerator as illustrated at upper right on page 2 of the above referenced Cushioneer bulletin, but it can be seen that at best this type of cooling is not only a makeshift arrangement but all of the energy taken from the moving load is lost.

A second notable point is that oftentimes the need for cooling is neither understood nor apparent to the installer of a decelerator, and unfortunately, the instructions furnished by decelerator manufacturers are often disregarded. When external decelerators are insufficiently cooled and are operated at high speed and/or high loads, the hydraulic fluid becomes overheated and reduced in viscosity so that the moving load may not be decelerated sufficiently to prevent the moving parts from striking with heavy impact. Frequent shut-downs are necessary to repair damage resulting from this type of operation.

A third point is that situations often occur in the field of hydraulic decelerators where considerable technical "know how" is required for a user or a salesman to choose and install a decelerator properly. The responsible person must be able to calculate load weight and velocity, and to substitute such values along with actuator requirement in a mathematical formula to work out the result correctly. The majority of persons involved with actuator installation cannot do this.

A fourth point is that if the installer is not skilled and careful, he may mount a hydraulic decelerator insecurely or in a misaligned position so that the impinging load applies a lateral load on the plunger. If this doesn't actually bend the plunger, it soon causes excessive wear on the plunger slide bearing and the hydraulic piston.

Because of the problems mentioned above, many years of development and testing work have been spent by applicant in an effort to construct a compact hydraulic decelerator with enough energy absorption capacity to be installed in both ends of pneumatic actuators to permit high operating speed. The restriction in space between the actuator piston rod and the inside of the actuator cylinder has been a major problem, as have leakage of the hydraulic fluid, tendency of the compressed air to enter the fluid and form bubbles, and overheating of the hydraulic fluid with consequent short life of the fluid seals.

SOLUTION OF PROBLEM

Described herein is the combination of a new type of hydraulic decelerative cartridge with mounting structures constructed for cooling the cartridge and adapted for general purpose use or attachable as heads to both ends of pneumatic actuators, and a new type of safety device which senses malfunction of a cartridge and stops operation of the actuator before damage can occur.

The improved hydraulic cartridge described is practical for use in the rod end head of a pneumatic actuator because it is so compact that its plunger can extend within the actuator cylinder while its adequately sized hydraulic cylinder is accommodated at one side of the actuator piston rod. The compactness is due to the combination of several features. First, the preferred plunger seal is a rolling diaphragm which is impervious to leakage of fluid or compressed air. The diaphragm is frictionless, it has only one convolution and contains a minimum amount of material. It therefore permits the plunger to move with minimum friction and inertia so it extrudes quickly and dependably by fluid pressure alone after each working stroke. No space is taken up by a plunger return spring. Second, the elastomeric type of bladder described is inherently elastic so that it maintains reserve pressure in the fluid sufficient to extrude the plunger without space being required for a spring to pressurize the fluid. Third, the bladder contributes a long working life to the diaphragm because the bladder has the characteristics of a low rate spring so that it maintains a moderate fluid pressure throughout the full stroke of the hydraulic plunger to keep the diaphragm from wrinkling without being overstressed. To explain, as the plunger moves inward, the bladder expands to compensate for the fluid displaced and causes more unit tension in its own elastomer, but it raises the fluid pressure less than would be excessive for the diaphragm because of its accompanying decrease in wall thickness as it increases in diameter.

It is disclosed herein that an ordinary sliding type of plunger seal may also be used with the bladder instead of a diaphragm, but such use is recommended only for environments harmful to a thin diaphragm, and where gradual leakage of the fluid is acceptable.

The mounting structure which holds the cartridge assembled to a pneumatic actuator is an essential component in the actuator combination, not only for its supportive function but also because it is provided with special passageways for air flow so that the air supplied to the actuator automatically keeps the cartridge cool.

It is felt that the safety device described herein should also be considered an essential component of the actuator combination. Pneumatic actuators equipped at both ends with the new hydraulic decelerative cartridges will often be operated at more than twice the safe piston velocity of an ordinary actuator. To protect personnel and equipment in the event of malfunction of a cartridge, the safety device should be included to stop the actuator automatically if for any reason the actuator piston approaches the end of its stroke at a dangerous velocity.

SUMMARY

The present invention, by providing a means of safely incorporating automatically cooled hydraulic decelerators within both ends of a pneumatic actuator, more than doubles the permissible piston velocity and productive capacity of an actuator, thereby saving equipment, space, and supervisional labor. In addition, this improved combination:

1. Safeguards personnel and actuator.
2. Saves energy. Briefly explained, each decelerator converts to heat (within its fluid), all the energy it absorbs as it brings the air piston to a stop. The improved actuator head in which the cartridge is mounted is configurated to cause the compressed air supplied to operate the actuator, to flow past the cartridge to cool it, and in doing so the air is heated. The supplied air is thereby expanded according to Charles' law and the air compressor is required to furnish less compressed air to the actuator than would be necessary otherwise.
3. Permits an actuator and its load to operate at a lower noise level than a system where external decelerators are used, because the noise of the air piston striking the hydraulic plunger rod is muffled by being enclosed within the air cylinder.
4. Insures constancy of decelerative action by keeping the hydraulic fluid automatically cooled.
5. Lengthens the life of the dynamic seals of the decelerators by keeping the seals cool and protected from abrasive material and harmful chemicals which may exist exteriorly of the actuator.
6. Insures constant lubrication and permanent cleanliness of the decelerator plunger rods for long life when supply air to the pneumatic actuator is filtered and lubricated.
7. Eliminates possibility of damage to decelerators due to faulty installation. Perfect alignment of internal decelerator with air piston travel precludes possibility of bending of decelerator plunger rods and minimizes plunger rod side bearing wear.
8. Eliminates necessity for user or salesman to calculate decelerator requirements and to choose the proper decelerators, because those installed in each actuator can be pre-selected by the manufacturer for size and adjustment range to satisfy the requirements of any mechanism for which that particular actuator is scheduled to be used.
9. The self contained hydraulic cartridges described herein may be adjusted to suit varied load requirements and may be quickly replaced in event of malfunction or change of use of the pneumatic actuator.

DEFINITIONS

For brevity in the following description, the rolling semi-toroidal fold which connects adjacent invaginated walls of the rolling diaphragm will be called a "convolution". The words "power pulse" will indicate a transient variation in power created either by starting or stopping a flow of power. The words "power pulse conductor" will be taken to mean an element capable of transmitting electricity, air, heat, or sound. The word "switch" will be used to designate electric, fluidic, or any other type switch which when operated can transmit a power pulse to a responsive air valve. The word "bore" will be taken to mean a hole which may vary in diameter and may extend part way into or through one or more blocks of material that are held together. "Reserve pressure" will mean the pressure within the hydraulic fluid when the cartridge plunger is in its fully extended position.

DESCRIPTION OF PREFERRED EMBODIMENTS

First Species Of Hydraulic Cartridge

Figures 1, 2, 3, 4, 5, 6, 7, 8:
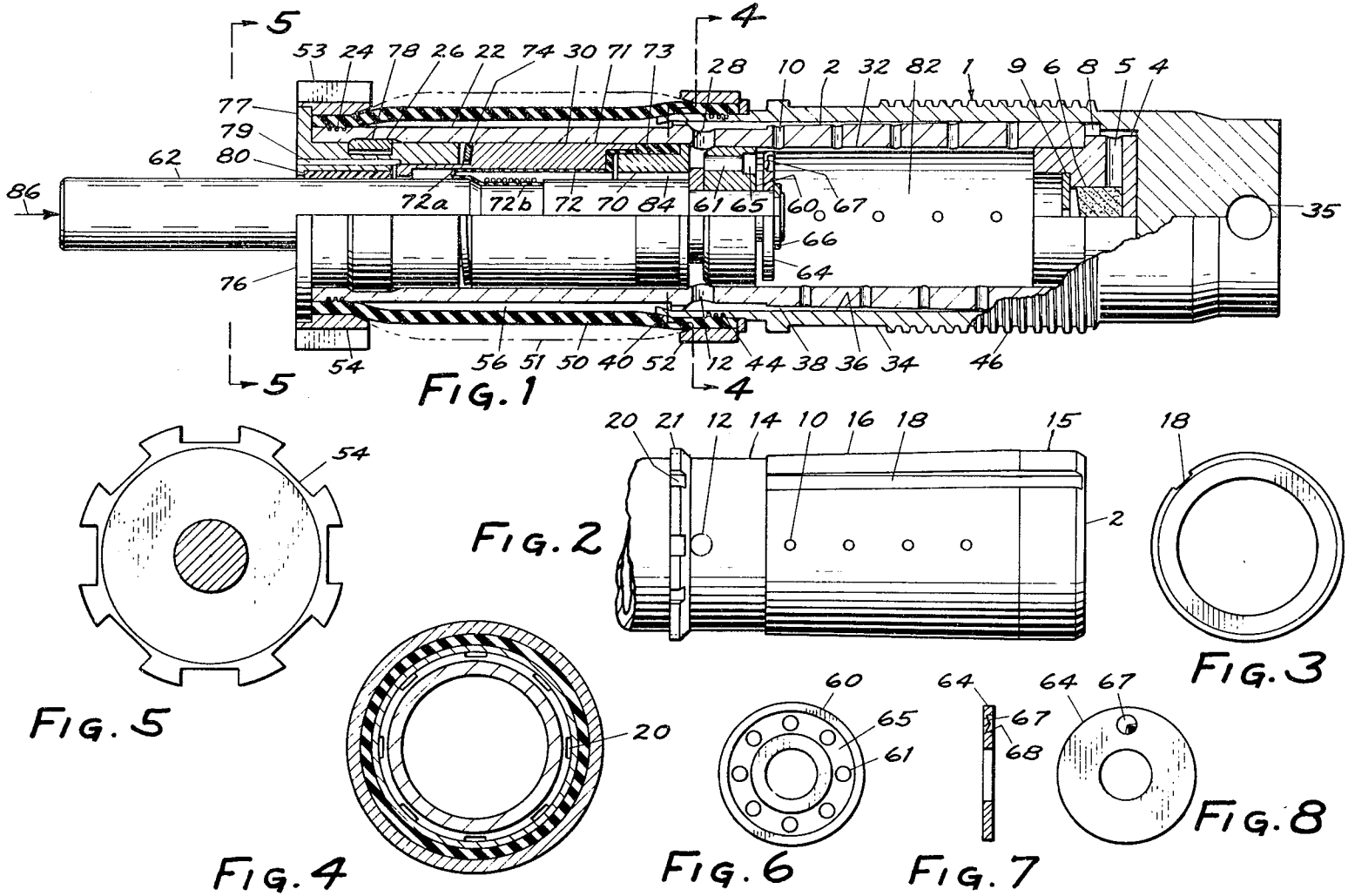
FIG. 1 is a substantially mid-sectional view of the first species of hydraulic decelerative cartridge of the present invention, the plunger being shown in its normally extended position at the start of a working stroke.
FIG. 2 is a fragmentary view of the cylinder of FIG. 1.
FIG. 3 is an end view of FIG. 2.
FIG. 4 is a transverse section on zigzag line 4—4 of FIG. 1, parts inside the cylinder being omitted.
FIG. 5 is an end view taken on line 5—5 of FIG. 1, showing the notches 54 in the periphery of the end clamp ring of the cartridge.
FIG. 6 is an end view of the piston per se of FIG. 1, showing the arrangement of ports 61 and the groove 65 connecting them.
FIG. 7 is a mid-sectional view of the valve of FIG. 1 showing the shear disc 67.
FIG. 8 is an end view of the valve of FIG. 7.

In FIGS. 1—8, numeral 1 indicates a hydraulic decelerative cartridge made according to the present invention. A cylinder member 2 intrinsically open on both ends is shown closed at one end by a plug member 4 fitted tightly into the cylinder and containing a porous metal filter element 6. Radial holes 5 permit filtered fluid to enter space 8. A perforated filter cover 9 helps trap foreign particles arrested by the filter. FIGS. 1 and 2 show that the wall of the cylinder is provided with fluid metering ports 10, fluid re-entry ports 12, external reduced diameter portion 14, cylindrical portion 15, tapered portion 16, longitudinal groove 18, flow notches 20 interspaced with raised lands 21, and cylindrical neck portion 22 with labyrinthine grooves 24. Internally the cylinder has a circumferential groove 26, and two bores meeting at shoulder 28, bore 30 being slightly larger than bore 32.

Jacket

Surrounding a portion of the cylinder is a jacket member 34 having a cylindrical bore 36 surrounding the tapering cylinder wall and forming a tapering circumferential space 38. The jacket has a conical swaged portion 40 retaining it on the cylinder and touching the cylinder at circumferentially spaced lands 21 so as to form small fluid flow openings 20 seen in FIG. 4. The jacket is preferably provided with labyrinthine grooves at 44, and threads 46 which also act as coolings fins.

Bladder and Clamp Rings

Sealed to the jacket and to the cylinder is an elastomeric bladder 50 which can expand as indicated by phantom line 51 to compensate for changes in fluid temperature or fluid displaced by the plunger 62 as is moves inward. The bladder is fastened to the jacket and cylinder by clamp rings 52 and 53 pressed over the ends of the bladder 50 forcing it into labrinthine grooves 24 and 44. Clamp ring 53 may be provided with notches 54 as shown in FIGS. 1 and 5 to permit air flow past the cartridge when it is installed in a pneumatic actuator as will be explained later herein. If environmental conditions and life expectancy permit use of a bladder material having a high degree of elasticity, then a bladder such as shown at 50 in FIG. 1 may be installed in a circumferentially stretched condition so that it exerts a squeezing action on the hydraulic fluid in chamber 56 to produce reserve pressure in all the fluid within the cartridge. This will be shown to be advantageous later herein.

Plunger Components

Mounted within the hydraulic cylinder is a hydraulic piston 60, hardened plunger rod 62, slidable check valve 64 retained by snap ring 66, a stationary flanged ring 70 positioned against shoulder 28, a tubular quill 71 and an elastomeric rolling diaphragm 72. The diaphragm has a single convolution 72*a*, an anchor bead 73 sealed between ring 70 and quill 71, an end anchor portion 72*b* sealed to the plunger rod, and a spring washer 74 to insure permanent sealing pressure of the quill against bead 73. A split snap ring 78 engaged in groove 26 retains a keeper 76 within the cylinder. The keeper has a flange portion 77 which retains clamp ring 53 in place, an air vent 79 which equalizes air pressure at convolution 72*a* with ambient air outside the unit, and a bearing bushing 80 which serves to guide the plunger rod. The piston divides the interior of the cylinder into a high pressure chamber 82 and low pressure chamber 84 and is provided with ports 61 which, due to fluid flow acting on the check valve, are automatically closed during working strokes, and open during retractive strokes.

In FIG. 6, the piston ports 61 are shown to be connected by a circular groove 65, and in FIGS. 7–8 valve 64 is shown provided with a shear disc 67, positioned radially aligned with groove 65 and integrally formed in the valve as the convex bottom of a counterbore 68. The shear disc is a protective feature which breaks out of the valve to protect the more expensive parts of the cartridge in case of a loss of fluid with consequent short deceleration stroke causing excessively high fluid pressure.

Principle of Deceleration

For drilling economy, the metering ports 10 are preferably all the same diameter, and to give maximum strength to the cylinder, are spaced circumferentially around the cylinder in several rows as indicated in FIG. 1. Ports 10 extend through the externally tapered surface 16 of the cylinder, those ports near the start stroke position of the piston thereby being spaced farther from the cylindrical bore surface 36 of the jacket than the ports near the end stroke position. By this means the start stroke resistance of the plunger can be arranged to be very light compared to its end resistance. This arrangement not only gives the quietest and smoothest stop to any load, but also permits an operator to adjust the decelerative action of the hydraulic cartridge by positioning the cartridge axially to utilize a smaller percentage of its stroke for light loads than for heavy loads, while retaining the desirable action of gentle deceleration for both types of loads. If there is need for unusual start stroke resistance relative to end stroke resistance of the plunger, a taper with gradually varying slope from start stroke to end stroke can be provided on the cylinder. Tapering grooves or a multiple stepped external surface on the cylinder roughly equivalent to a taper may be provided if found more economical to manufacture.

Operation of Cartridge

FIG. 1 shows plunger rod 62 in its extended position at the start of a working stroke. When an external load is applied to the end of the rod as shown by arrow 86, the rod moves inward closing valve 64 so that the fluid within high pressure chamber 82 is pressurized creating resistance to decelerate the load. Fluid simultaneously flows from chamber 82 through metering ports 10, generating heat, then flows through space 38 and re-entry ports 12 to enter the chamber above the piston. A part of the fluid flowing through space 38 passes flow notches 20 and expands bladder 50 to compensate for the fluid displaced by the plunger rod. Simultaneously a small percentage of fluid flows through the high resistance filter 6 out through radial holes 5 and through longitudinal groove 18 to return above the piston thru re-entry ports 12. After the external load at 86 is removed, the plunger rod is returned to its extended position by reverse pressure maintained in the fluid by circumferential tension in bladder 50, the fluid flows previously described then being reversed but very slow while check valve 64 opens to permit fast flow through piston ports 61 to enable the plunger rod to extend quickly.

Jacket 34 is provided with wrenching means such as a hole at 35 for adjustment of the cartridge plunger stroke when the cartridge is supported by the threads at 46.

Second Species of Hydraulic Cartridge

Figure 9:
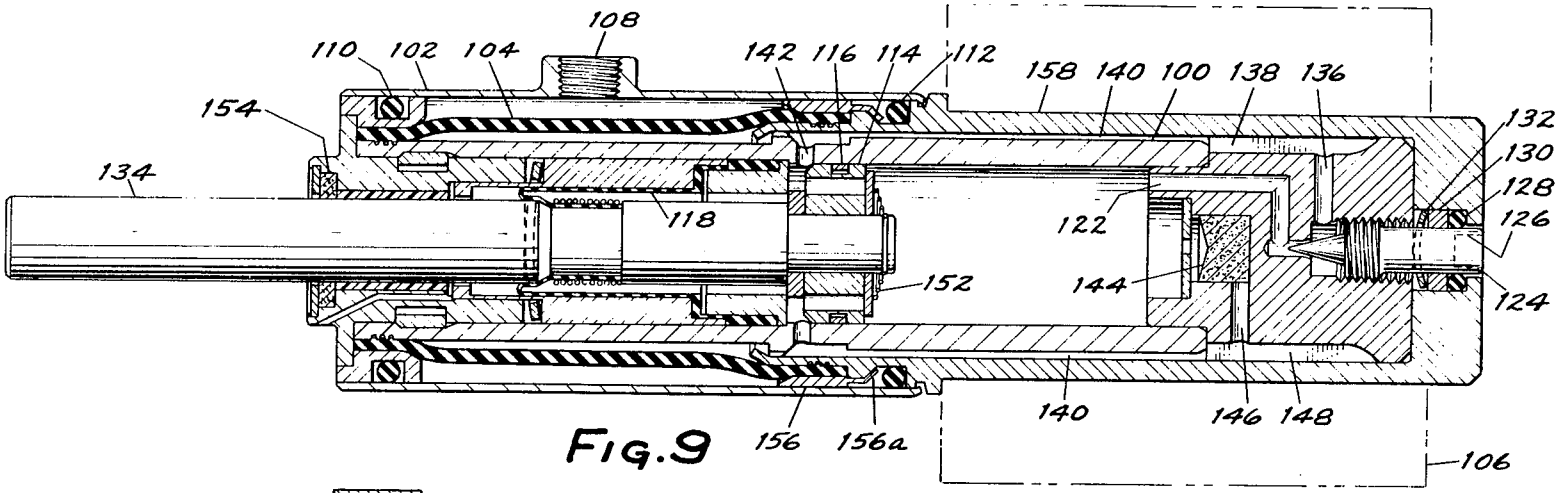
FIG. 9 is a mid-sectional view of a second species of hydraulic cartridge embodying this invention, a support block 106 being shown in phantom.

In the second species of cartridge shown in FIG. 9, the cylinder has an unperforated wall throughout the piston stroke range and an encasement structure 102 encloses bladder 104. The encasement prevents physical damage to the elastomeric material of the bladder where it extends outside of its support block 106. In addition, the encasement may be utilized to transform the cartridge into an inexpensive and efficient control for pneumatically operated tools such as drill presses used for peck drilling. As disclosed in U.S. Pat. No. 3,680,970, copy of which is enclosed, peck drilling requires that the drill bit be moved quickly to the work piece and decelerated, then be fed repeatedly into and out of the work, the hydraulic cartridge plunger controlling the feed only while the drill is cutting. The cartridge of FIG. 9 is capable of this action if the encasement is provided with air inlet port 108 and "O" rings 110 and 112, while the piston 114 is provided with a friction producing expandable split piston ring 116 and the bladder is arranged to have light tension to exert just enough reserve pressure in the fluid within the unit to keep the diaphragm 118 properly shaped and free of wrinkles, but not enough pressure to move the piston against the frictional drag of ring 116. Air pressure supplied through port 108 by an automatic valve can then be utilized to extrude the cartridge plunger at the proper times as indicated in U.S. Pat. No. 3,680,970.

The use of an air pressurized encasement as described also permits use of a non-tensioned elastic bladder if conditions require use of a bladder material having poor elastic qualities.

Continuing with FIG. 9, an opening 122 by-passing filter 144 provides a passageway to a velocity regulating threaded needle valve 124 which is externally accessible for adjustment by means of hex socket 126 to regulate fluid flow through its seat. The needle valve is sealed with "O" ring 128, a pressure washer 130, and spring washer 132. The valve controls the velocity at which rod 134 and piston 114 can move so that the full stroke of the rod can be utilized for controlling velocity at a steady rate. Fluid passing the needle valve returns to the cylinder above the piston via passageway 136, slot 138, space 140, and re-entry ports 142. Fluid passing radially thru the filter 144 returns to the cylinder via passageway 146, slot 148, and space 140.

Other minor optional features of FIG. 9, are the valve spring 152 to maximize length of effective stroke of the plunger rod 134, rod wiper 154 to keep the rod clean, clamp ring 156 being swaged at **156*a* to hold it firmly to the jacket, and the smooth jacket exterior 158**.

Third Species of Hydraulic Cartridge

Figure 11:
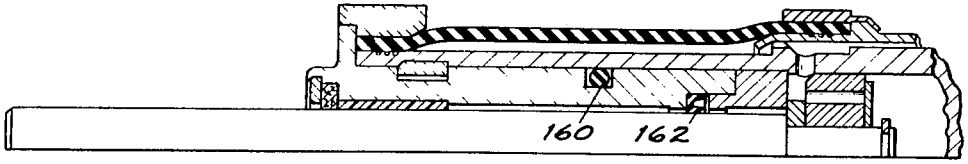
FIG. 11 is a fragmentary half sectional view of a third species of cartridge embodying this invention.
Figure 10:
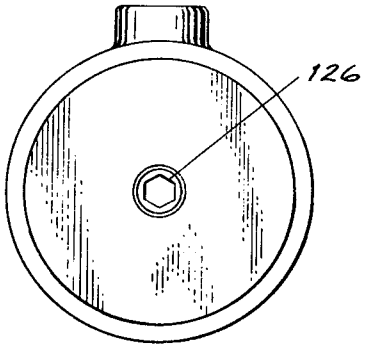
FIG. 10 is an end view of the cartridge of FIG. 9 showing the adjustable valve with wrench socket 126.

In some environments, a thin elastomeric diaphragm such as 118 in FIG. 9, is susceptible to deterioration by oils or aromatic fluids which can enter through the keeper vent or the plunger guide bushing. FIG. 11 shows part of a cartridge in half section made according to the present invention and rendered safe for use in such hostile environments by being equipped with an "O" ring 160 and an ordinary sliding seal 162 instead of a diaphragm. The seal shown is of the "U" packing type but could be any of the other types of close fitting sliding seals made of chemically resistant material. Sliding seals have higher friction than diaphragms and also leak slightly, but if usage is moderate, a practical length of service life can be expected before enough fluid leaks out to prevent full extrusion of the plunger by fluid pressure.

It is intended that the various features illustrated combined in FIGS. 1, 9 and 11 may be interchanged and recombined irrespective of the arrangement shown in the drawings. For example, the needle valve 124 of FIG. 9 may be combined with the ported cylinder of FIG. 1 to augment the load adjustment capability of thread 46. The valve spring 152 of FIG. 9 may be combined with the check valve of FIG. 1 to add slightly to the working stroke of the piston.

Special Bladders

Figure 13:
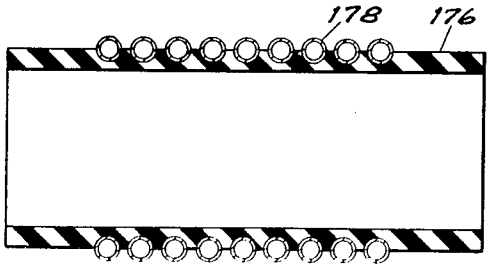
FIG. 13 is a mid-sectional view of a bladder encircled by garter springs and optionally usable as a component of this invention.
Figure 12:
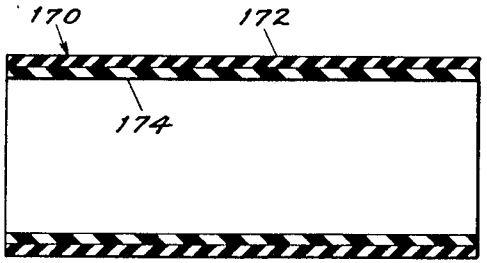
FIG. 12 is a mid-sectional view of a double walled bladder optionally usable as a component of this invention.

FIGS. 12–13 show two types of bladder, either one of which may be applied to the hydraulic cartridge instead of the type shown in FIG. 9. In FIG. 12, numeral 170 indicates a double walled elastomeric bladder consisting of outer wall 172 which may be made of environmentally resistive material, and an inner wall 174 having the necessary resistance to swelling by the hydraulic fluid. One or both walls could furnish squeezing action on the hydraulic fluid necessary to extend the cartridge plunger. FIG. 13 illustrates a bladder which will reliably maintain the fluid reserve pressure for an indefinitely long time. It comprises a grooved wall elastomer 176 encircled by metal garter springs 178. It has been found by trial that the bladder and springs expand and contract without abrasive wear between them. However, the expense of providing and installing such a bladder must be justified by a requirement for an unusually long life of fluid reserve pressure.

Cartridge With Cooling Feature

Figure 14:
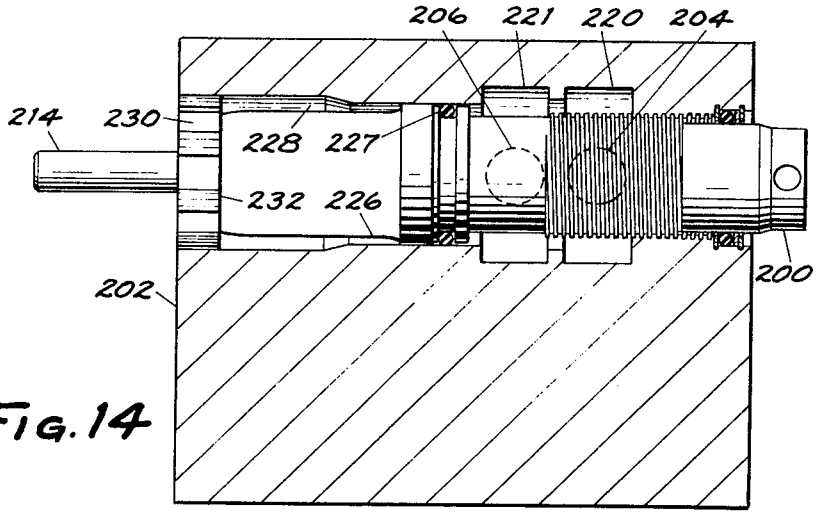
FIG. 14 is a mid-sectional view of a cartridge mounted for general purpose use, the mounting block 202 incorporating passageways for forced air cooling for the cartridge, numeral 204 indicating in phantom the location of passageway 204 of FIG. 15.
Figure 15:
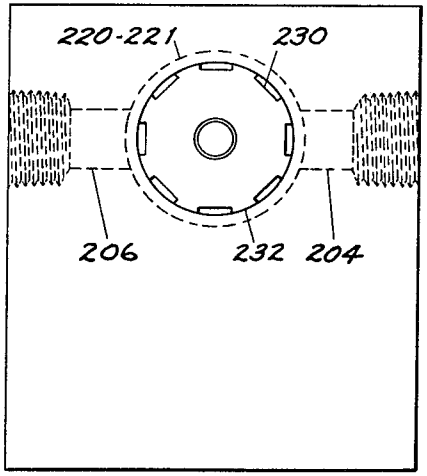
FIG. 15 is an end view of FIG. 14.
Figure 16:
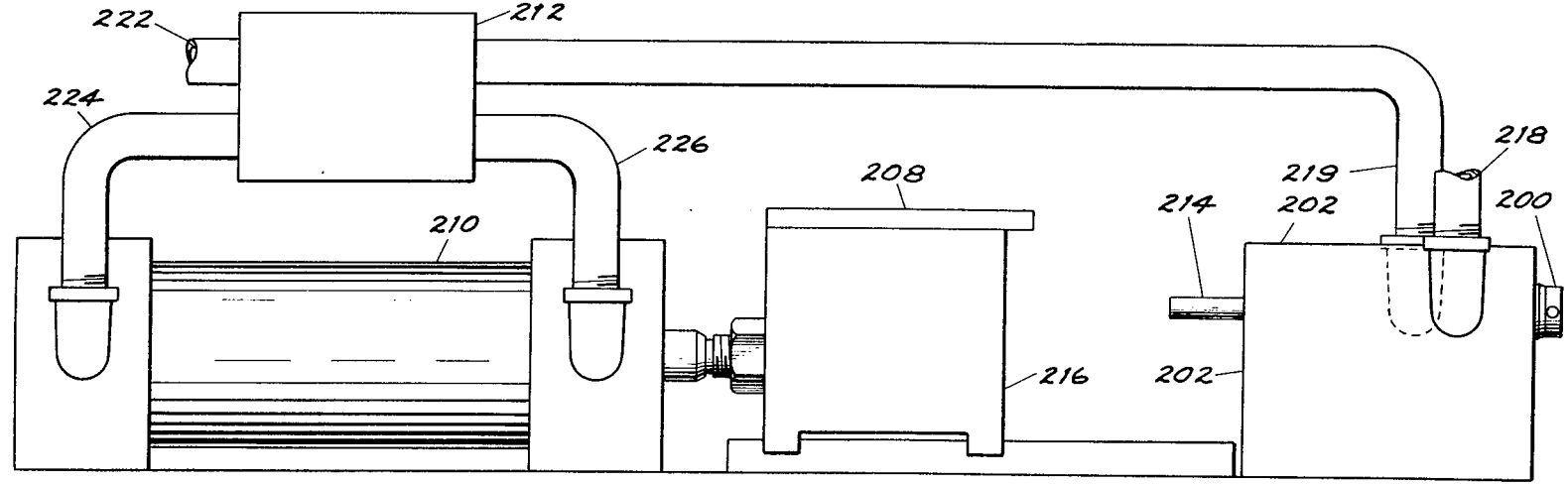
FIG. 16 is an elevational diagrammatic view of the cartridge 200 of FIG. 14, positioned to control the motion of a mechanism 208 operated by a remote pneumatic actuator.

It was mentioned earlier, that a hydraulic decelerative cartridge becomes overheated if operated continually. The overheating problem may be eliminated as shown in FIGS. 14–16 wherein cartridge 200 is supported by a mounting block 202 which contains passageways 204 and 206 and annular passages 220 and 221 to lead air flow around the cartridge body for cooling purposes. The combination shown is for general purpose use in decelerating any moderate duty moving mechanism 208 operated by a pneumatic actuator 210 controlled by a remote valve 212. To accomplish its purpose the mounting block 202 is secured in position with plunger 214 of the cartridge extending into the stroke range of the moving mechanism so that surface 216 of the moving load strikes plunger 214. With pipe connections as shown, the supplied compressed air enters block 202 through pipe 218, is heated as it flows past the cartridge via passageways 204, 220, 221 and 206, exits from the block through pipe 219 to operate the actuator and exhausts from the valve through pipe 222. A less efficient arrangement, which omits heating the supplied air, results if the air flow is reversed to pass through block 202 last. In the arrangement of FIGS. 14–16 the cartridge is installed from the left side of the mounting block and compressed air is kept from leaking past bladder 226 by an "O" ring seal 227, the bladder chamber 228 having vented by notches 230 in the cartridge clamping ring 232 to permit ambient air to enter or leave chamber 228 as the bladder expands and contracts. The arrangement shown is not the most efficient possible because only a portion of the cartridge body is exposed to the flow of cooling air. However, additional cooling is provided to the cartridge by metal to metal heat conduction into block 202 which is also cooled by air flow.

Actuator With Automatic Cooling

FIGS. 17-20 show several decelerative cartridges 300, 302, 304, 306, and a dummy cartridge 308 combined with mounting structure forming heads 310 and 312 attached to a pneumatic actuator cylinder 314 and providing automatic cooling of the cartridges. Two (or more) cartridges in each actuator head improve the cooling action due to the increased cooled surface they provide; they also permit the actuator to operate efficiently with heavier loads and/or higher air pressure, and also provide an obvious safety feature. If one decelerator should malfunction, the adjacent one will prevent excessive impact of the air piston 316 against head 310 or 312 even though the active cartridge may be temporarily overloaded until the failed cartridge can be replaced.

The dummy cartridge 308 has no functioning parts. It is substantially solid and shaped approximately like the exterior of a working cartridge. It is utilized only to form sealed plug means to prevent the escape of air from the cylinder in the event no working cartridge is installed in a cartridge position. It may contain an air vent 310 which permits air flow to and from cylinder 314 similar to that permitted by an active cartridge.

Figure 17:
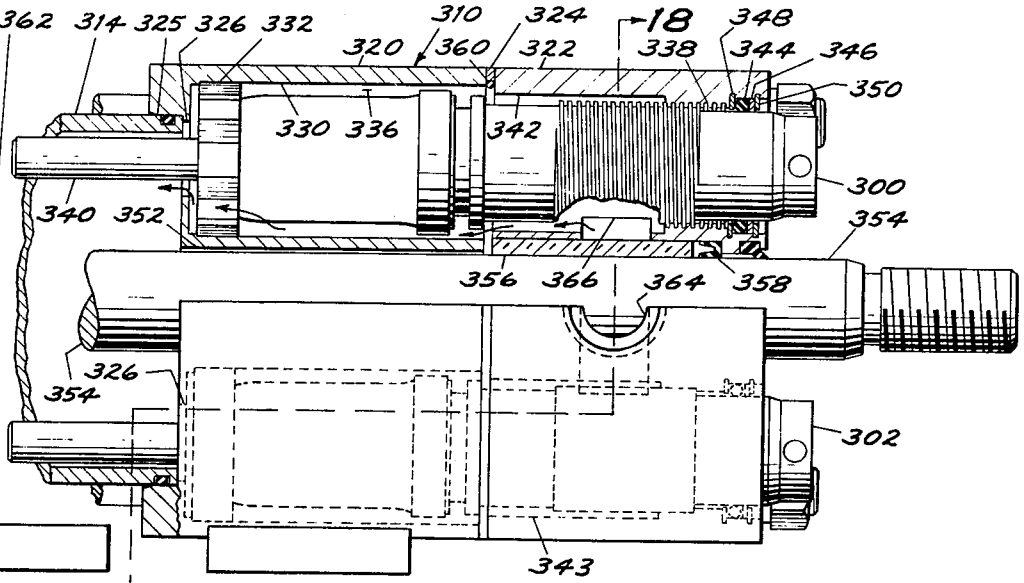
FIG. 17 is a half mid-sectional view of the rod-end head of a pneumatic actuator, the single head comprising two blocks equipped with two of the new, hydraulic decelerative cartridges.
Figure 18:
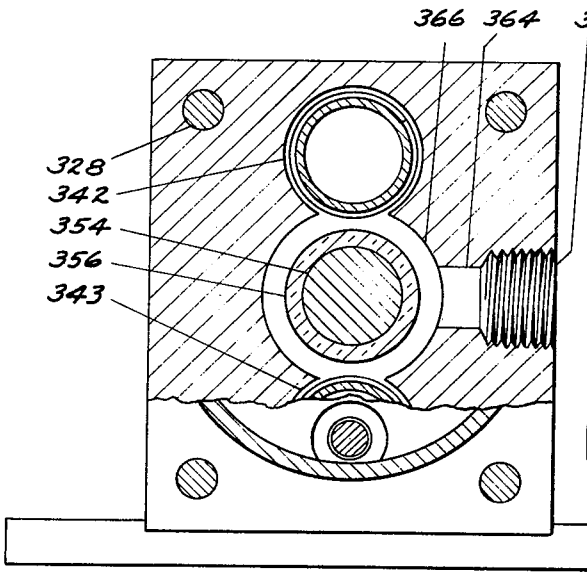
FIG. 18 is a partial section taken on zigzag line 18—18 of FIG. 17, parts inside the cartridge cylinder being omitted.
Figure 19:
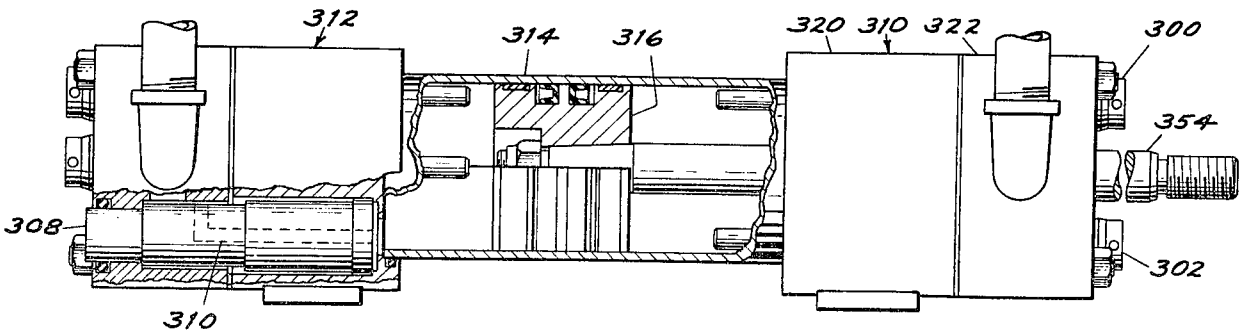
FIG. 19 is a partially sectionalized elevation of a pneumatic actuator equipped with four of the new hydraulic cartridges and one dummy cartridge.
Figure 20:
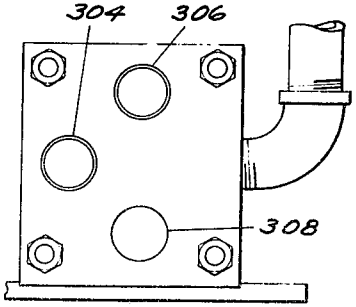
FIG. 20 is an end view of FIG. 19.

Referring to FIG. 17, the mounting structure comprises primary block 320 with secondary block 322 and gasket plate 324. The two blocks must be separated to allow installation of the cartridges shown in FIG. 17 as will be explained presently. Primary block 320 is counterbored at 325 to receive the end of air cylinder 314. Four tie rods 328 hold the actuator assembled. Bore 330 supports the notched clamp ring 332 of the cartridge, which is similar to ring 53 of FIG. 1. The bore clears the remainder of the cartridge to form a passageway 336 for air flow. Secondary block 322 is provided with female thread 338 which supports the threaded portion of cartridge 300 and provides a means of adjusting the position of the cartridge axially to vary the working stroke of plunger rod 340. Thus may the decelerative action be conformed to the particular air pressure and load under which the pneumatic actuator is operating. Referring again to FIG. 17, bore 342 clears the cartridge and forms a continuation of passageway 336 for air flow nearly full length of the cartridge, "O" ring seal 344 with backup washer 346 being provided between two snap rings 348 and 350 to prevent the escape of compressed air and to provide friction to keep the cartridge from rotating and changing its adjustment. Bore 352 accommodates air piston rod 354 which extends through a standard type of bushing 356 and "U" packing seal 358. Gasket plate 324 supports a peripheral elastomeric seal 360 between blocks 320 and 322 to prevent the escape of air. Secondary block 322 is shown in FIG. 18 to have a threaded port 362 leading into a bore 364. Compressed air supplied through bore 364 enters an annular passageway 366 which surrounds bushing 356 and communicates with bores 342 and 343. The compressed air is thereby led as shown by the arrows to flow at high speed completely around the cartridges and out through the notches in clamp rings 332 and openings 326 to enter the air cylinder 314 around the plunger rods during a power stroke. During the subsequent exhaust stroke, exhaust air is made to flow in the reverse direction completely around the cartridge and out through the port 362. The rush of air past each hydraulic cartridge and its plunger in both directions provides highly efficient cooling of the cartridge and the plunger.

Increase of Efficiency

Automatic cooling of the cartridges not only lengthens cartridge life but also increases efficiency for the entire working system because all of the compressed air supplied by the compressor is heated as it passes the cartridge and expands in volume according to Charles' law before it enters the air cylinder. Therefore any certain amount of work done by the actuator of FIG. 17 requires a smaller volume of air to be delivered by the compressor than the same amount of work would require if done by an actuator without cooled decelerators.

Actuator With Eccentric Piston Rod

An actuator head made up of two blocks which are separable as in FIG. 17 permits installing the type of cartridge shown in FIG. 17, the cartridge being smaller in diameter at the threads than at the bladder end. This arrangement gives maximum possible radial space for the piston rod and its bushing and seal which are concentric with the air cylinder. However, the piston rod is limited in diameter and this is a disadvantage if an unusually long stroke is required for the actuator because then an oversize piston rod must be used for greater columnar strength.

Figure 21:
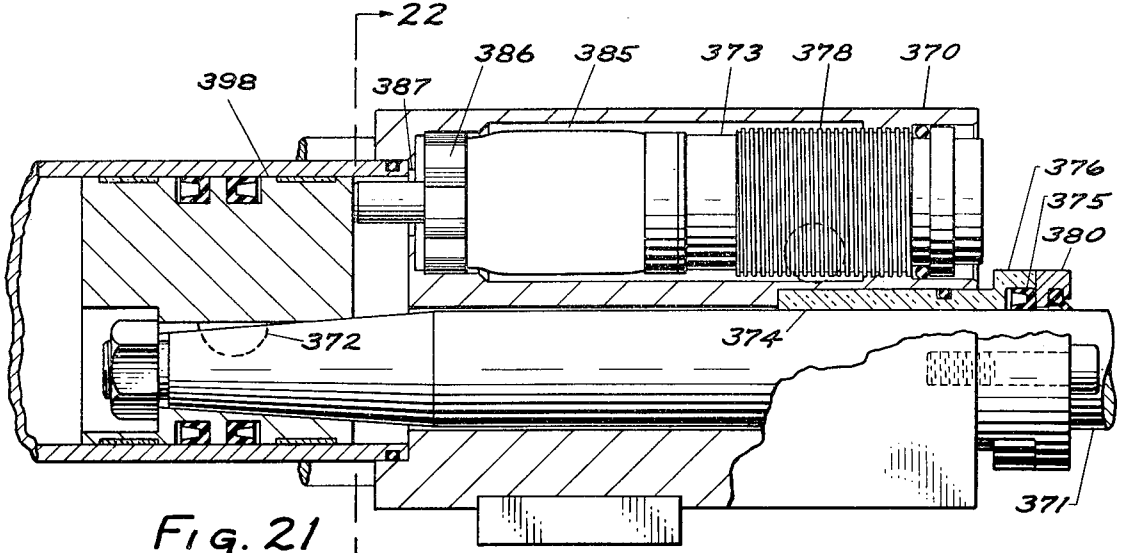
FIG. 21 is a partially sectionalized elevation of the rod-end head of a smaller sized pneumatic actuator, with an oversize piston rod positioned eccentric to the air cylinder to make room for the oversize rod and a relatively large cartridge.
Figure 23:
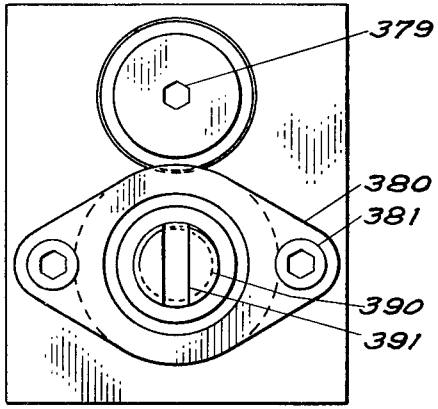
FIG. 23 is an end view of FIG. 21 showing a threaded end on the piston rod.
Figure 22:
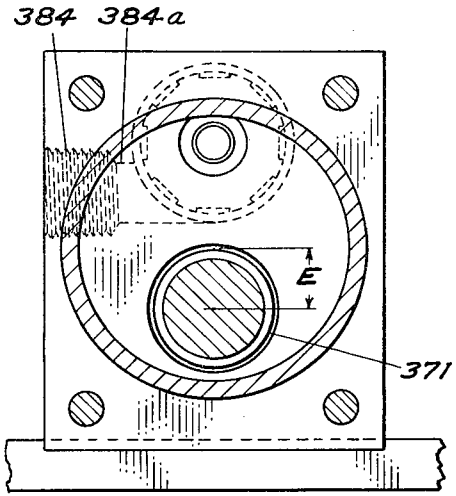
FIG. 22 is a transverse section on line 22—22 of FIG. 21.

FIGS. 21-23 show a one piece actuator head 370 with an oversize piston rod 371 keyed to the piston at 372 and positioned eccentrically to the air cylinder an amount "E" to give radial room for the oversize piston rod and for a relatively oversize decelerative cartridge 373, the air cylinder diameter being smaller than that of FIG. 17. Rod bushing 374 carries seal 375 outside of the head block and is provided with a flange 376 which incidentally limits the range of axial adjustment of the cartridge provided by threads 378 and hex socket 379. The bushing is removable, being held in place by a partially enshrounding retainer 380 and screws 381. The cartridge of FIG. 21 has a thread larger in diameter than the bladder end so it can be installed from the outer end of the block if bushing 374 is first removed. Provision for cooling the cartridge is the same as explained for FIG. 17, compressed air being led to flow past the cartridge via inlet port 384, passageways **384*a* and 385, and notches in claim ring 386 and opening 387. It will be seen that more than one cartridge could be installed in the head of FIGS. 21-23, also that if the actuator piston rod were concentric, the one piece head could be constructed to accommodate the same type of cartridge as in FIG. 21**, but the cartridge would be limited to a smaller size.

Figure 24:
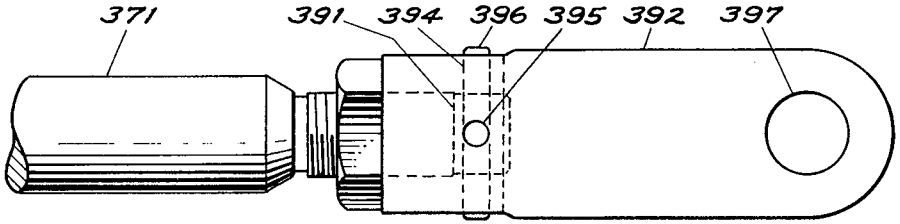
FIG. 24 is a fragmentary elevational view of FIG. 23 showing a clevis attached to the piston rod.
Figure 26:
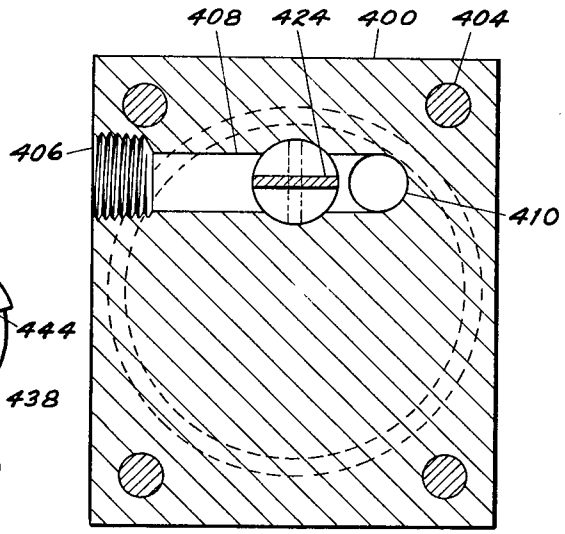
FIG. 26 is a transverse section on line 26—26 of FIG. 25.
Figure 29:
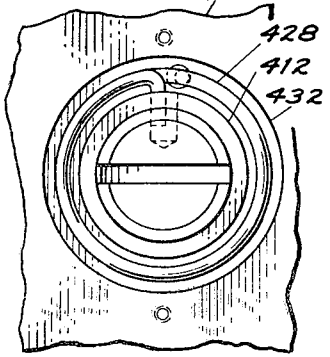
FIG. 29 is an end view of FIG. 27 with the end plate 430 removed to show the torsion spring 428.
Figure 28:
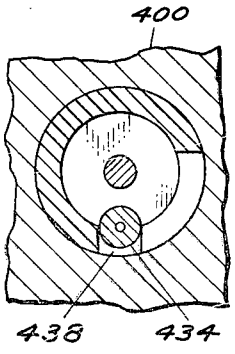
FIG. 28 is a fragmentary transverse section on line 28—28 of FIG. 27 showing how the latch pin 434 engages notch 438.

FIG. 23 is a view of the right end of the head of FIG. 21 showing a threaded end on the piston rod at 390 provided with a diametric slot 391 aligned with the direction "E" of the eccentricity of the piston rod relative to the air cylinder. FIG. 24 illustrates a mating clevis 392 provided with two holes 394 and 395. A pin 396 can be inserted in either hole through rod slot 391 to unsure that the axis of clevis hole 397 is parallel or perpendicular to the eccentricity of the piston rod. The installer therefore has visual means of keeping piston 398 in its properly indexed free-sliding position relative to its eccentricity with the air cylinder.

THE SAFETY DEVICE

First Species

As mentioned earlier, any reciprocative mechanism moved by a pneumatic actuator can unintentionally be operated at piston velocities high enough to cause destructive impact at the ends of the stroke. The new safety device shown in FIGS. 25–44 prevents this.

Figure 25:
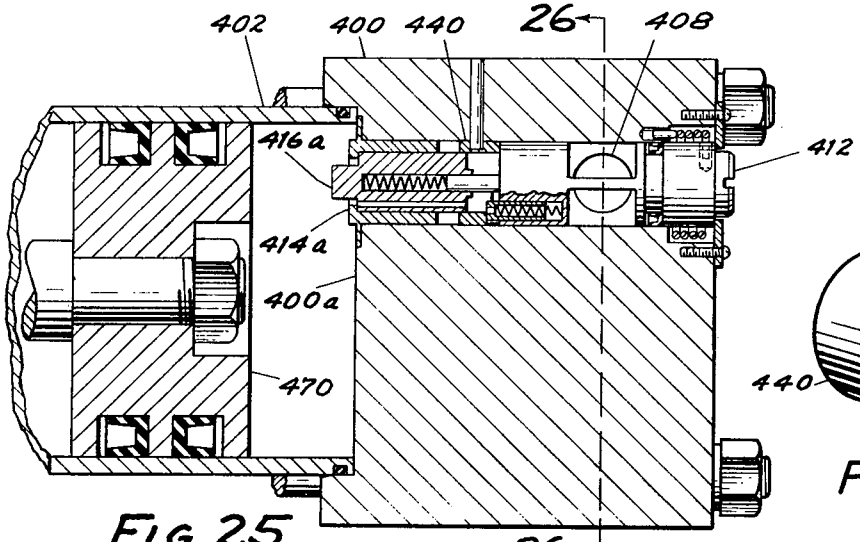
FIG. 25 is a fragmentary mid-sectional view of the rear end head of a pneumatic actuator equipped with the first species of safety device of the present invention.
Figure 27:
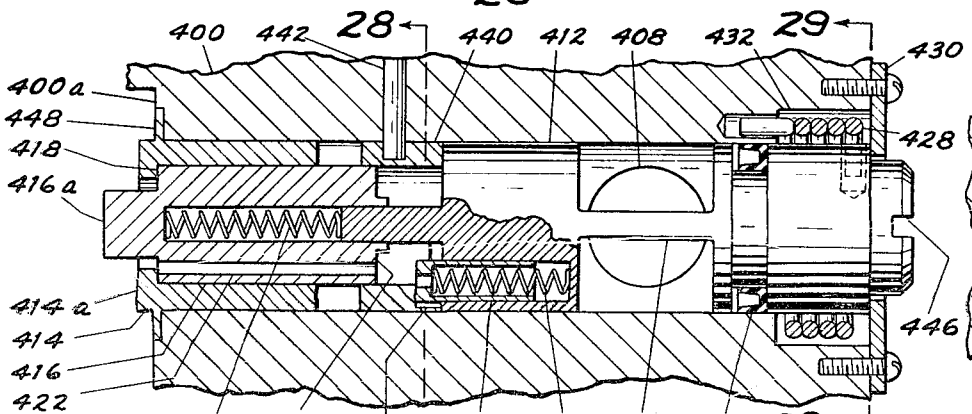
FIG. 27 is a fragementary enlarged sectional view of the safety device of FIG. 25.

The assemblage of parts comprising the first species is shown in FIG. 25 retained in working relationship within a rear head block 400 attached to a pneumatic actuator cylinder 402 by tie rods 404 and having an inlet port 406 and air passageway 408 and 410 leading into the actuator cylinder. FIG. 27 is an enlarged view of the safety device which is shown to include rotatable spool 412 positioned within passageway 408 and adapted to automatically shut off the air supply to prevent damage to the actuator in the event of just one fast approach of the air piston 470 close to stop surface 414*a* of the shear bushing 414. Associated with the spool is a slidable hammer member 416 which is continuously urged toward a retaining shoulder 418 by a spring 420. The hammer is provided with an air vent passage 422 so that it may move freely against the action of the spring. The hammer head projects beyond surface 414*a* of the bushing so that each time the air piston approaches the end of its stroke at moderate velocity, the hammer head is depressed just until its end surface 416*a* is even with surface 414*a*.

Figure 30:
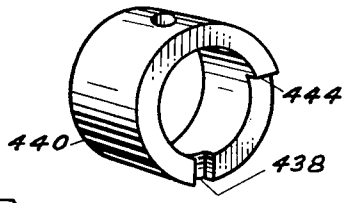
FIG. 30 is a perspective view of the notched ring 440 of FIG. 25.

The rotatable spool 412 has a shutoff web 424 and is provided with an elastomeric seal 426 to prevent escape of air. The spool is continuously urged by torsion spring 428 to rotate counterclockwise when viewed as in FIG. 29. The spool is retained axially between plate 430 and stepped ring 440 and one end carries an axially slidable latch pin 434 urged by a light spring 436 into contact with the bottom of notch 438 provided in ring 440. The ring is secured in place by pin 442 and as seen in FIG. 30 is provided with step 444 to limit rotation of the spool to 90°. The spool has a screw driver slot 446 accessible outside of the head block so an operator can rotate the spool against the action of spring 428 until pin 434 latches into notch 438, web 424 then being aligned to permit air flow through passageways 408 and 410 into the cylinder 402. While engaged in the notch, latch pin 434 extends into the stroke path of hammer member 416 and is disengageable from the notch by the end 416*b* of the hammer member if the hammer end surface 416*a* should be depressed below surface 414*a* of bushing 414.

Operation of First Species of Safety Device

A pneumatic actuator equipped with the safety device of FIGs. 25–30 would be operated so that the air piston 470 stopped against shear bushing surface 414*a* with light impact at the end of each stroke, depressing the hammer head only until its end surface 416*a* is even with surface 414*a*. However, in the event the air piston approaches the end of its stroke traveling at high velocity, it strikes the hammer head with abnormally high impact and causes the hammer head to travel below surface 414*a* due to its inertia. When this occurs, hammer end 416*b* strikes latch pin 434, disengages it from notch 438 and permits spool 412 to rotate 90° under the actuation of torsion spring 428 until the latch pin strikes shoulder 444. Web 424 then is in its phantom position of FIG. 26 so that it restricts the flow of supply and exhaust air through passageway 408 greatly reducing or stopping movement of the air piston in both directions. To insure reliability of operation, spool 412 should be a loose fit in the head block, although when in its "closed" position, a small amount of compressed air will continue to flow and allow very slow cycling of the actuator.

A user, experiencing a shut-down of his pneumatic actuator due to action of the safety device of FIG. 25, can resume operation by repairing the defect causing stoppage and resetting the device with a screw driver.

Figure 31:
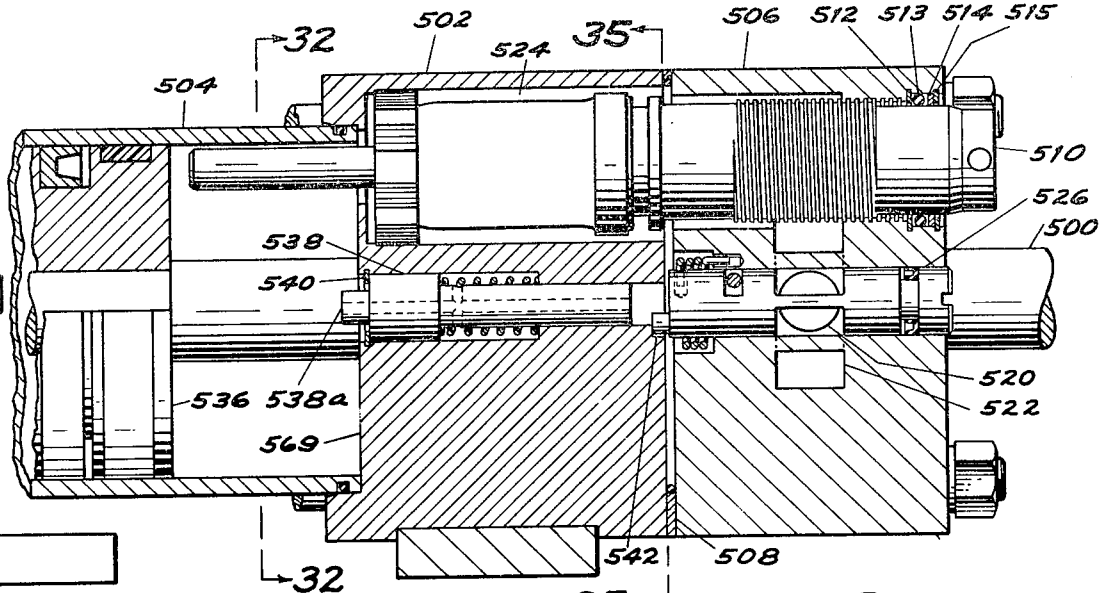
FIG. 31 is a fragmentary mid-sectional view of the rod end head of a pneumatic actuator, the single head comprising two blocks equipped with one of the new hydraulic cartridges and the second species of safety device of this invention, taken on zigzag line 31—31 of FIG. 32 and including an end portion of the actuator piston.
Figure 32:
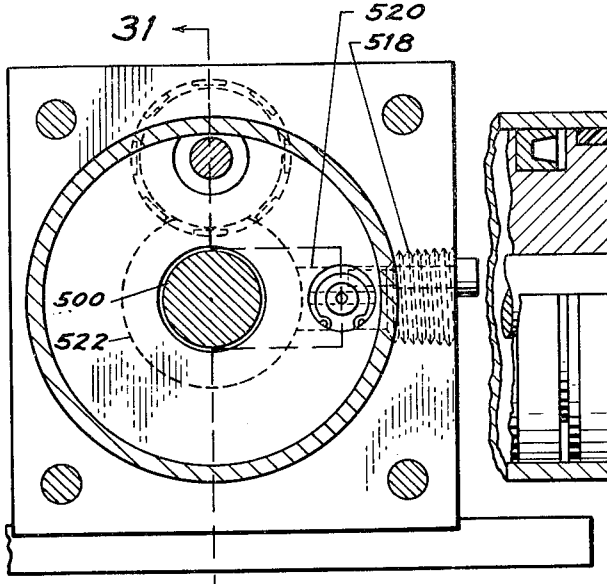
FIG. 32 is a partial section on line 32—32 of FIG. 31.
Figure 36:
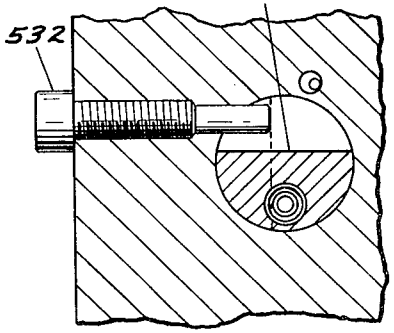
FIG. 36 is a fragmentary sectional view on line 36—36 of FIG. 33 showing how the double purpose screw 532 limits rotation of the spool.

The shear bushing 414 is a redundant safety feature of the safety device and will usually be omitted as shown in FIGS. 31–32 where the stop surface 569 for the actuator piston is provided by the head block itself. Bushing 414 insures operation of the safety device under very unusual working conditions where hammer 416 might become immovably lodged in its depressed position due to sludge or corrosion. In such case if piston 470 strikes surface 414*a* at excessively high speed, flange 448 will shear and permit bushing end 414*a* to be pushed in even with surface 400*a*, thereby forcing the hammer to disengage the latch pin.

Second Species of Safety Device

FIG. 31 shows a two part rod end head for an actuator including the combination of a single decelerative cartridge with the safety device, the head structure being provided with air passageways for cooling the cartridge. The rear head for the actuator would be essentially the same except that provision for the air piston rod 500 would be omitted.

Figure 33:
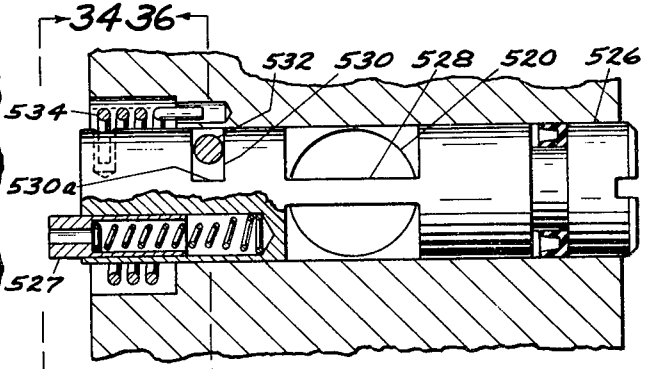
FIG. 33 is a fragmentary enlarged sectional view of the spool portion of the safety device of FIG. 31.
Figure 34:
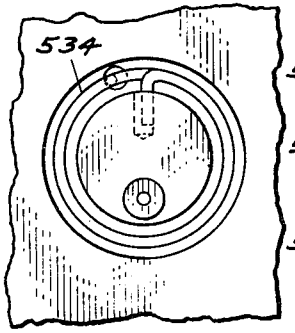
FIG. 34 is a fragmentary end view on line 34—34 of FIG. 33 showing the torsion spring 534.
Figure 35:
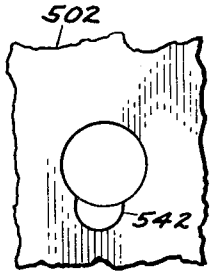
FIG. 35 is a fragmentary view on line 35—35 of FIG. 31 showing the notch 542 cut into primary block 502.

Referring to FIGS. 31–33, the actuator head comprises a primary block 502 assembled to air cylinder 504 with secondary block 506 and gasket plate 508 supporting cartridge 510 with seal parts 512–515 similar to FIG. 17. The blocks contain air inlet 518 and passageways 520,522, and 524 so supply air flows around the cartridge for cooling. The safety device spool is provided with latch pin 527 and web 528 arranged to control air flow through passageway 520. Notch 530 in the spool is engaged by screw 532 to retain the spool axially and to limit its rotation by contacting surface 530*a* of the notch when in the phantom line position of FIG. 36. Torsion spring 534 is located at the latching end of the spool and rotates the spool clockwise as seen in FIG. 34 to interrupt air flow if triggered by excessive impact of air piston 536 against the end 538*a* of hammer 538. The hammer is retained inexpensively by snap ring 540 instead of a shear bushing as in FIG. 25. The notch 542 arranged for engagement by the latch pin is formed in the primary head block 502 as shown in FIG. 35.

Figure 37:
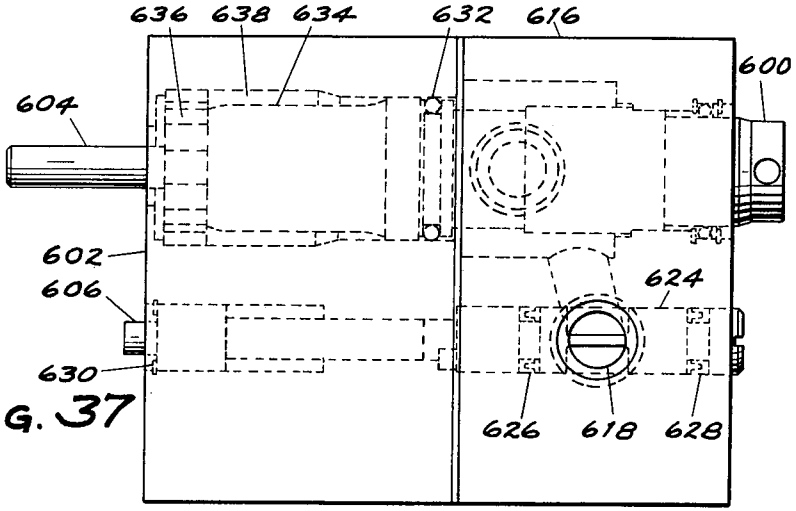
FIG. 37 is an elevational view of a hydraulic cartridge and the second species of safety device of the present invention mounted in a two-block structure for general purpose use.
Figure 38:
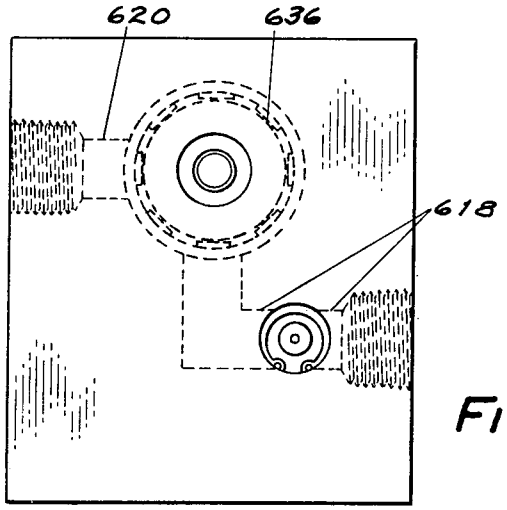
FIG. 38 is an end view of FIG. 37 showing the dotted air passageways for cooling the cartridge.
Figure 39:
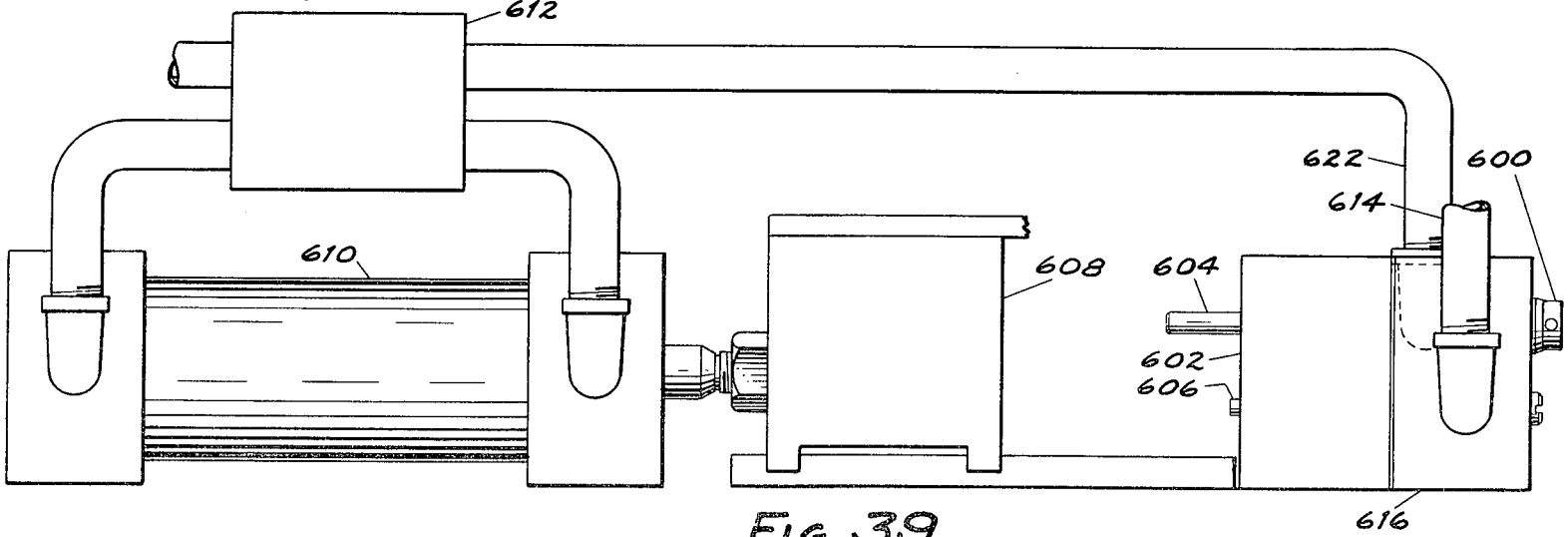
FIG. 39 is an elevational diagrammatic view of the device of FIG. 37 arranged to control the motion of a mechanism 608 operated by a remote pneumatic actuator.

In FIGS. 37–39 the second species of safety device (with one additional fluid seal 626) is shown diagrammatically combined with a hydraulic decelerator for general purpose use, the safety device providing the same protection as when installed within a pneumatic actuator. In this arrangement the mounting structure is shown to include two blocks for holding the decelerator, the primary block 602 being positioned so that hydraulic cartridge plunger 604 and hammer 606 can be actuated by surface 608 of a mechanism moved by a pneumatic actuator 610, the actuator being operated by a remote valve 612. The compressed air supplied first passes through pipe 614 then through secondary block 616 via passageways 618 and 620 to cool cartridge 600, then on to the valve through pipe 622, the safety device being positioned to interrupt air flow through passageway 618 if triggered by excessive impact from surface 608. In this case, spool 624 is the same as spool 526 of FIG. 33 except that it carries one additional elastomeric seal 626 to prevent escape of air entering through passageway 618. Hammer 606 is retained by snap ring 630 and operates the same as hammer 538 of FIG. 31. Cartridge 600 is provided with an "O" ring seal at 632 to prevent supply air from escaping past bladder 634, while notches 636 serve only to vent the bladder chamber 638 to atmosphere.

It will be seen that the safety device of FIGS. 37–39 combined with the mounting structure containing air passageways could be used alone without the decelerative cartridge if the user so desired. With that arrangement, air piston velocity of the actuator would normally be regulated by regulating the flow of supply or exhaust air, or by using an external decelerator. In any case, the safety device would stop movement of the mechanism if it approached the end of its stroke at excessive velocity.

Third Species of Safety Device

Figures 40, 41:
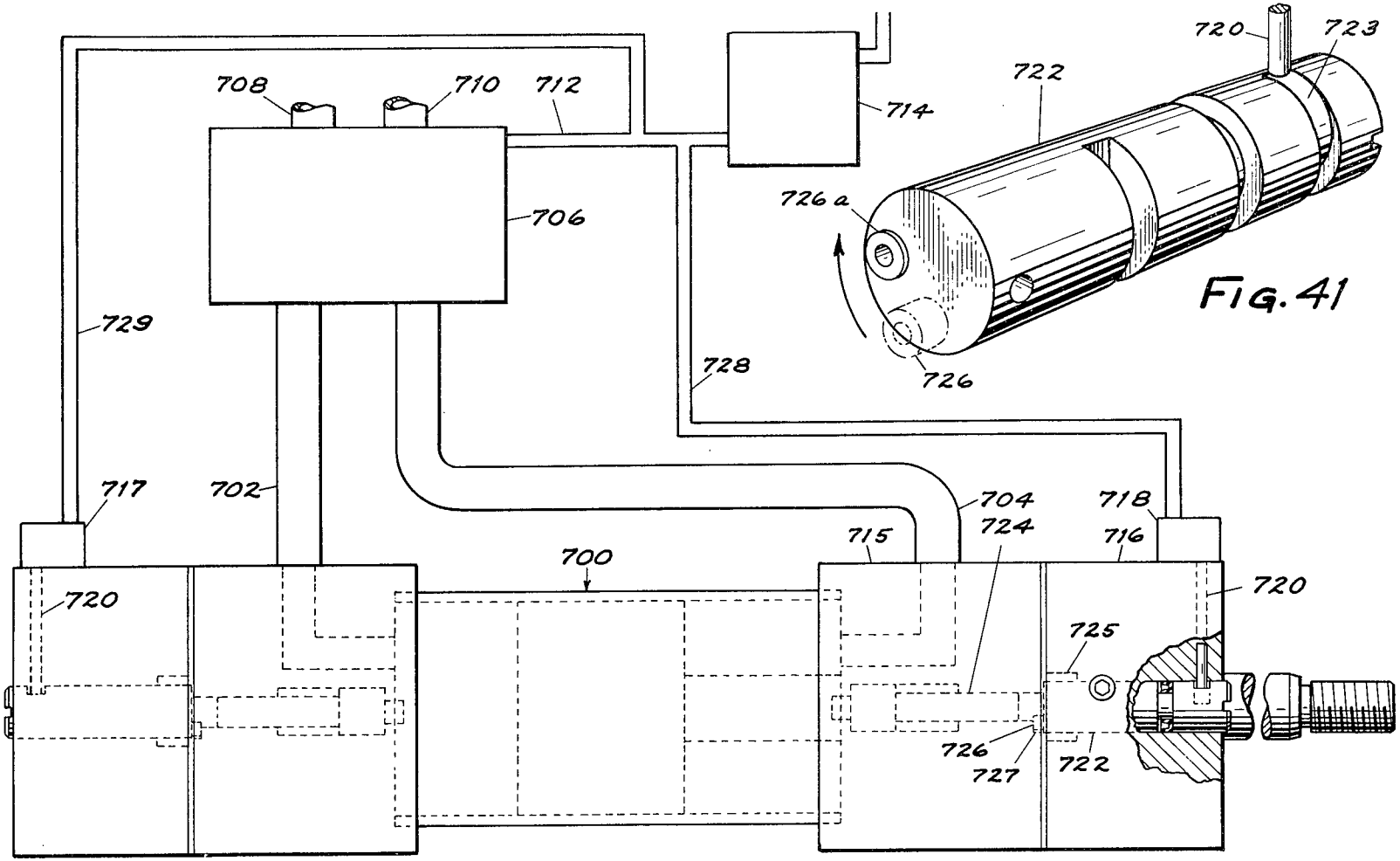
FIG. 40 is an elevational diagrammatic view of a pneumatic actuator equipped at both ends with a third species of the safety device of the present invention and operated by a remote valve.
FIG. 41 is a perspective view of the cam spool 722 of FIG. 40.

Combination of the safety device monitoring the control system of a remote valve is shown diagrammatically in FIG. 40 wherein the supply air to both ends of an actuator 700 is led thru pipes 702 and 704 from an external automatic four way valve 706 which receives and exhausts air through pipes 708 and 710 respectively, and is controlled to cycle actuator 700 automatically by power pulses received through a power pulse conductor 712 leading from a power pulse transmitting timer 714. The rod end head includes primary block 715 and secondary block 716. Switches 717 and 718 are provided on the actuator heads, each switch being arranged to be actuated by a rod 720 which is in turn actuated by a rotatable cam spool 722 within the head. The cam spool, shown in detail in FIG. 41, contains a cam surface 723 and is accessible for resetting exteriorly of the head. It is controlled by a hammer 724, a torsion spring 725, and a latch 726 which are similar to those of the spool 526 of FIG. 33. The latch pin 726 is shown in phantom lines in FIG. 41 and in dotted lines in FIG. 40 as it would be positioned when engaged in notch 727 permitting switch 718 to be inoperative. When the latch is forced into the spool by the hammer 724, the spool rotates as shown by the arrow, raising rod 720 and operating the switch, the latch pin then being in position 726*a*. Switches 717 and 718 are connected via power pulse conductors 728 and 729 into the power pulse conductor 712 leading from the timer, to interrupt the flow of power pulses to valve 706 when either switch is actuated, thereby stopping the actuator until spool 722 can be reset.

Fourth Species of Safety Device

Figure 42:
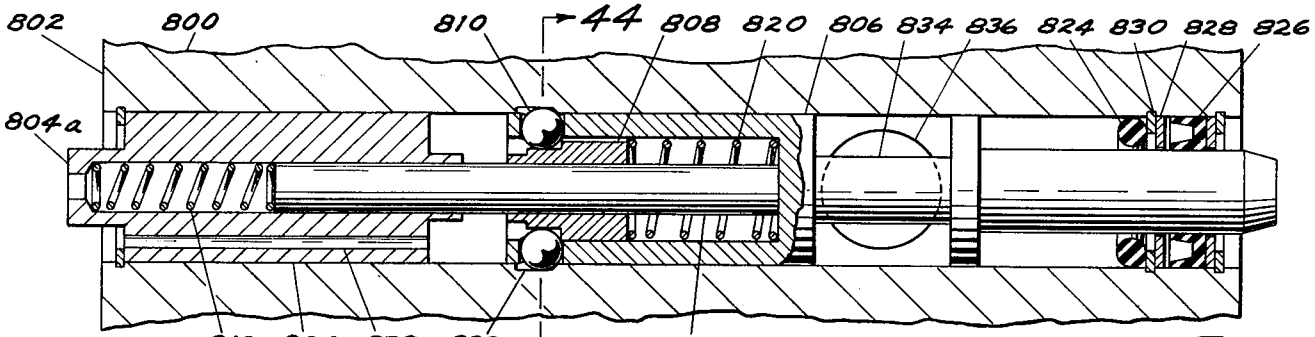
FIG. 42 is an enlarged longitudinal sectional view of a fourth species of the safety device with the spool positioned to permit air flow, taken on line 42—42 of FIG. 44.
Figure 43:
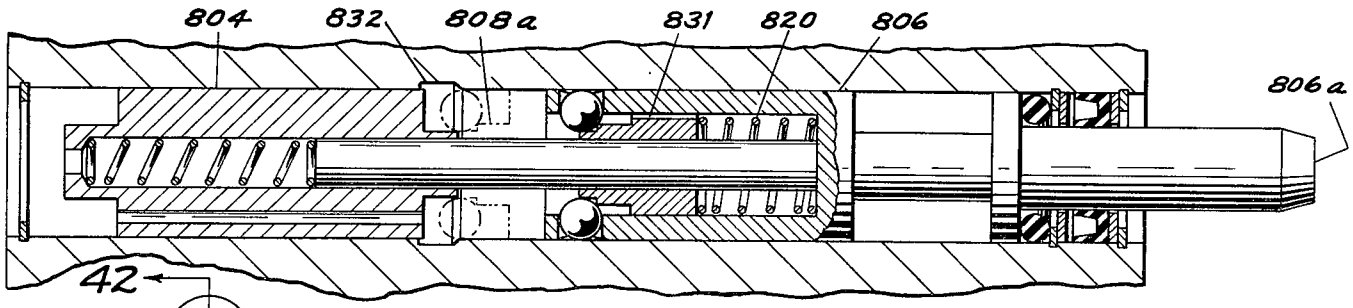
FIG. 43 is a similar view of the device of FIG. 42 with the spool positioned to prevent air flow.
Figure 44:
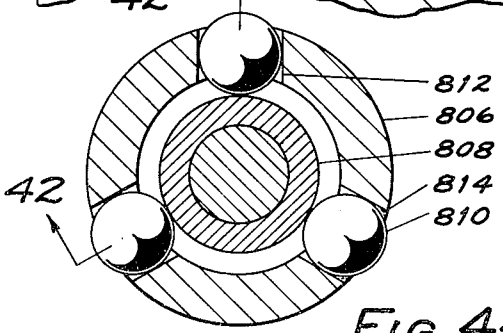
FIG. 44 is a transverse section at line 44—44 of FIG. 42.

Each of the three species of safety device previously described employs a rotative spool to monitor the flow of supply air. The fourth species employs a sliding spool valve for the same purpose, and, as illustrated in the enlarged views of FIGS. 42–43, it is applicable to an actuator head block 800 which has a stop surface 802 for the actuator piston similar to surface 569 of FIG. 31, the end 804*a* of hammer 804 protruding therefrom to be moved each time the actuator piston approaches surface 802. As seen in FIGS. 43–44 the spool 806 carries a stepped cone 808 actuating a plurality of steel balls 810 movable radially in holes 812. The holes may be peened as shown in phantom at 814 or the cone may be magnetized steel to retain the balls before the spool is installed in the head. Other features shown in FIGS. 42–43 are the light springs 818 and 820, the rod 822, a rubber "O" ring 824 which acts as a shock absorber, and seal 826 which is retained by washers 828 and snap rings 830 to prevent the escape of air. Vent groove 831 permits equalization of air pressure both sides of cone 808.

Operation of Fourth Species

The spool is retained in the position of FIG. 42, the balls being expanded outward into groove 832 by the cone, thus permitting supply air for the actuator to pass freely around neck 834 into passageway 836 (which corresponds to passageway 520 of FIG. 31). When end 804*a* of the slidable inertia hammer 804 is struck by the actuator moving at a dangerously high speed, the hammer moves by inertia against the action of light spring 818, and in traveling to its position of FIG. 43 moves the cone against spring 820 into the phantom line position 808*a* releasing the balls from groove 832 and permitting the spool to move into its solid line position 806 of FIG. 43 to close passageway 836. The spool is moved very quickly by spring 818 combined with air pressure from the actuator cylinder entering through vent 838 so that a shock absorbing "O" ring as at 824 helps to protect seal 826.

A user, experiencing a shut-down of his pneumatic actuator due to action of this safety device, can resume operation by repairing the defect causing stoppage and resetting the device by pushing spool end 806a inward until the balls lock the spool in place.

Remark on Safety Device

It has been proven by numerous actual tests with actuators containing decelerators and safety devices as described herein, that when a hydraulic decelerator malfunctions, it usually does so by losing its fluid gradually, and during subsequent strokes, the air piston gradually reaches an end velocity sufficient to close the safety device valve without striking the actuator head even one harmful blow. Even if the decelerator should fail instantly, one heavy blow to the head is all that is possible before the safety device operates.

What is claimed is:

1. In combination, (1) a pneumatic actuator comprising a head structure, a pressure cylinder attached thereto, a reciprocative piston slidably disposed in said pressure cylinder, a mechanical stop means supported by said head structure and positioned to limit the stroke of the piston, said pneumatic actuator being operated by a flow of compressed air, and means comprising a conduit for conveying air under pressure into said cylinder, and (2) a safety device for preventing excessive impact of said reciprocative piston against said mechanical stop means comprising a normally open valve in said conduit which is responsive to motive power impulses and operative to close and maintain a closed position in response to a motive power pulse, a weighted movable hammer member having first and second positions, first resilient means bearing against said hammer member, an impact receptive element positioned to receive motive power pulses from the second position of said hammer member, said hammer member and said impact receptive element having spaced opposed impact striking surfaces, and means for transmitting motive power pulses from said receptive element to said valve to cause said normally open valve to close, said hammer member having three critical positions, a first position conditionally maintained by said first resilient means bearing against said hammer member and holding said first portion protruding into the stroke path of said piston, a second position into which said hammer member is forced when said piston contacts said mechanical stop means and a third position in which said second portion of the hammer member strikes said impact receptive element, said hammer member having a structural shape which precludes it from contacting said impact receptive element while disposed in said second position, the force of said resilient means and the weight and shape of said hammer member being correlated to permit said hammer member to move against said first resilient means from said second position to said third position by inertia to close said valve when the impact of said piston against said mechanical stop means and said hammer member exceeds a predetermined safe value; and (3) means for mounting said safety device on said pneumatic actuator in the stroke path of said piston.

2. The combination of claim 1 wherein said valve in the safety device comprises a rotatable spool valve contoured and positioned to be open or closed to air flow through said conduit depending upon its rotational attitude, second resilient means comprising a torsion spring continuously urging said spool valve to rotate into its closed position, and latching means comprising a slidable spring-urged pin positioned eccentrically in an end of said spool valve, said impact receptive element being said pin which is engageable within a detent notch provided in said head structure to hold said valve open against the action of said second resilient means, a portion of the end of said pin meanwhile protruding from said notch into the stroke path of said hammer member and disposed to be disengaged from said notch to close said valve when forcefully contacted by said hammer member as it reaches its third position, said spool valve having a portion accessible from the exterior of said head structure to permit manual resetting of said spool valve into its open position.

3. A safety pneumatic actuator having two head structures and a cylinder attached thereto containing an air piston movable through a stroke by flow of compressed air, a first one of said head structures comprising a passageway for admitting compressed air to said cylinder, and a stop surface to limit the stroke of said air piston and comprising a control system including a normally open air valve adapted to control flow of compressed air through said passageway, said valve being operative to block said flow of air in response to a motive power pulse transmitted thereto, a safety device for sensing the velocity of the air piston at the end of its stroke and automatically causing the flow of compressed air to said cylinder to be blocked when said velocity reaches a dangerously high value, said safety device comprising: a movable hammer member having a first end surface adapted to be contacted by said air piston and a second end surface adapted to move into a pulse transmitting position to send power pulses to said valve, an impact receptive element positioned in said first head structure spaced from said stop surface and having an opposed impact striking surface to receive impact power pulses from said second end surface, and means to transmute and transmit said impact power pulses from said receptive element to said valve to close said valve, there being an intervening distance provided between said stop surface and said receptive element, said hammer member being movably supported within said first head structure against a positioning surface, resilient means urging said hammer member against said positioning surface with said first end surface protruding from said stop surface into the stroke range of said piston, said resilient means being arranged to restrict the movement of said hammer member to an idling stroke equal to its protrusion each time said piston approaches said stop surface with moderate velocity, said hammer member having a length between said first and second end surfaces of smaller dimension than said intervening distance, whereby to preclude impacting of said receptive element while said hammer member remains in contact with said air piston, said hammer member having an amount of weight correlated with said resilient means enabling said hammer member to leave said piston by inertia and to bridge said intervening distance to reach its pulse transmitting position to strike said receptive element and close said valve when said hammer member is struck by said air piston moving at an excessive velocity which is unsafe or otherwise undesirable.

4. The device of claim 3 wherein said means to transmute and transmit impact power pulses comprises a movable camshaft supported within said first head structure and is provided with detent means, second resilient means continuously urging said camshaft to move into a signaling attitude resting against said detent means, a cam rider, an adjacent switch arranged to be connected to said valve and an external source of power and adapted to be actuated by said cam rider to transmit a motive power pulse through a conductor to said valve to close same when said camshaft moves into said signaling attitude, said impact receptive element being a latch member adapted to lock said camshaft from moving relative to said head structure into said signaling attitude, said latch member being located in disengageable alignment with said hammer member, and positioned to be contacted and disengaged by said hammer when said hammer member moves across said intervening distance by inertia, said camshaft being accessible exteriorly of said head structure to permit manual resetting into its latched position.

5. In combination, a head structure, a pneumatic cylinder attached thereto, a reciprocative piston in said cylinder, said head structure forming a closure for said cylinder and including a stop surface contactable by said piston to limit the stroke of said piston, said head structure comprising an air inlet passageway for leading compressed air to said cylinder and being adapted to be connected to a source of compressed air, a safety device for sensing the velocity of said piston near the end of its stroke and automatically causing the flow of air to the cylinder to be blocked when said velocity reaches a dangerously high value, said device comprising: an inertial hammer member having weight and being movably supported within said head structure, first resilient means urging said hammer member against a positioning surface with said hammer member protruding beyond said stop surface into the stroke range of said piston, a normally open movable air valve provided with a detent and located within said head structure to control air flow through said passageway, latching means adapted to lock said valve in position open to air flow, second resilient means continuously urging said valve to move into a closed position resting against said detent, said latching means having an impact receptive portion contactable by said hammer member and adapted to be moved into a disengaging position to cause said valve to close, said impact receptive portion, when in its disengaging position, being separated from said stop surface by a dimension greater than the intervening dimension of said hammer member whereby disengagement of said latch with consequent shut-off of air flow can be accomplished only when said hammer member travels by inertia away from the stop surface far enough to reach said impact receptive portion, said resilient means and weight of said hammer member being correlated to permit said piston to strike said stop surface and hammer member repeatedly at a velocity predetermined to be safe, yet to permit said piston to strike only once with sufficient velocity to propel the hammer member projectile-wise from said stop surface with enough inertia to overcome the urging of said resilient means and move said latch into said disengaging position.

6. A reciprocative pneumatic actuator, a mechanism operated by said actuator, a stop surface positioned to limit the stroke of said mechanism, and a safety device for cutting off the air supply to said actuator in the event said mechanism strikes said stop surface at an unsafe velocity, said safety device comprising: a base block having a passageway for compressed air flowing to said actuator, a valve provided with detent means positioned to control air flow through said passageway, latching means adapted to normally lock said valve in an attitude open to air flow, a first spring means continuously urging said valve to move into a closed attitude against said detent, a movable hammer member, a positioning surface therefor, a second spring means adapted to hold said hammer member in a first position against said positioning surface with a portion of said hammer member protruding into the stroke path of said mechanism, thereby adapting the hammer member to be moved through an idling stroke equal to its protrusion to a second position each time said mechanism strikes the stop surface with moderate velocity, said second spring means permitting said hammer to bounce ahead of said mechanism and to move beyond its second position by inertia to a third position when struck by said mechanism moving at excessive velocity, said latching means being constructed, arranged, and positioned to be disengaged by said hammer member when said hammer member reaches its third position to strike said latch means whereby said valve is closed.

7. An assembly comprising (1) a pneumatic actuator having a pressure cylinder, a piston having a piston rod fixed thereto which protrudes from the cylinder, said piston being slidably disposed for reciprocating movement in the pressure cylinder responsive to air under pressure, and means for stopping the piston at the end of its stroke, (2) a mechanism to be moved and stopped simultaneously with the piston, said mechanism being fixed to the protruding end of the piston rod for reciprocating movement therewith, (3) a safety device external of the actuator of sensing the velocity of said mechanism as the mechanism approaches the end of its stroke, (4) means comprising a conduit external of the actuator for conveying air under pressure into the cylinder, said safety device comprising a spool valve and detent means for positioning said spool valve in a closed position, said spool valve being disposed externally of said actuator in communication with said conduit to control air flow therethrough, latching means for locking said spool valve normally open to air flow, a first resilient means for urging the spool valve into a position resting against said detent and closed against air flow, a movable hammer member protruding from said safety device, means for positioning the hammer member, a second resilient means adapted to urge said hammer member against said positioning means with said hammer member protruding into the stroke range of said mechanism adapting the hammer member to be moved through an idling stroke equal to its protrusion into said stroke range when the mechanism approaches the end of its stroke at a moderate velocity, said second resilient means permitting the hammer member to move beyond its idling stroke by inertia when struck by the mechanism moving at an excessive velocity, said latching means being disengaged by said hammer member striking said latching means when moving beyond its idling stroke thereby permitting said spool valve to close.

8. The subject matter of claim 3, and redundant safety means comprising a shearable bushing retained with end clearance within a counterbore in said first head and surrounding and axially retaining said hammer member, said bushing having an end portion protruding from said head and forming said stop surface, an internal shoulder forming said positioning surface, and an exterior circumferentially and radially extending fractural shear flange to permit said bushing to be forced into deeper engagement within said counterbore to compel movement of said hammer member into its pulse transmitting position in the event said piston strikes said stop surface with exceptionally high impact.

* * * * *